US008327632B2

(12) United States Patent
Phillips et al.

(10) Patent No.: US 8,327,632 B2
(45) Date of Patent: Dec. 11, 2012

(54) EXHAUST SYSTEM COMPRISING CATALYSED SOOT FILTER

(75) Inventors: Paul Richard Phillips, Royston (GB); Martyn Vincent Twigg, Cambridge (GB)

(73) Assignee: Johnson Matthey Public Limited Company, London (GB)

( * ) Notice: Subject to any disclaimer, the term of this patent is extended or adjusted under 35 U.S.C. 154(b) by 1032 days.

(21) Appl. No.: 12/280,932

(22) PCT Filed: Feb. 13, 2007

(86) PCT No.: PCT/GB2007/050059

§ 371 (c)(1),
(2), (4) Date: Aug. 27, 2008

(87) PCT Pub. No.: WO2007/099363

PCT Pub. Date: Sep. 7, 2007

(65) Prior Publication Data

US 2009/0071131 A1 Mar. 19, 2009

(30) Foreign Application Priority Data

Feb. 28, 2006 (GB) ..... 0603898.8

(51) Int. Cl.
*F01N 9/00* (2006.01)

(52) U.S. Cl. ..... 60/297; 60/286; 60/295; 422/108

(58) Field of Classification Search ..... 60/286, 60/295, 297; 422/108

See application file for complete search history.

(56) References Cited

U.S. PATENT DOCUMENTS

| | | | | |
|---|---|---|---|---|
| 4,029,472 | A * | 6/1977 | Micheli et al. | 422/108 |
| 5,363,091 | A | 11/1994 | Kotwicki et al. | |
| 6,037,183 | A | 3/2000 | Faber et al. | |
| 6,242,263 | B1 * | 6/2001 | Faber et al. | 436/143 |
| 6,332,965 | B1 | 12/2001 | Sugiyama et al. | |
| 6,546,721 | B2 * | 4/2003 | Hirota et al. | 60/297 |

(Continued)

FOREIGN PATENT DOCUMENTS

DE 23 30 749 A1 1/1975

(Continued)

OTHER PUBLICATIONS

Emissions Advantage, LLC., Wrap Offroad Diesel Retrofit Guidance Document (Nov. 18, 2005), vol. 2—Section II, p. 2.II-2.*

*Primary Examiner* — Kenneth Bomberg
*Assistant Examiner* — Brandon Lee
(74) *Attorney, Agent, or Firm* — Kevin M. Carroll

(57) ABSTRACT

An exhaust system which has a catalysed soot filter (CSF), a control unit, and a catalyzed sensor. The exhaust system, controllable by the control unit, can increase hydrocarbon (HC) and/or carbon monoxide (CO) content in an exhaust gas flowing into the CSF resulting in combustion of the HC and/or CO in the CSF, a temperature increase of the CSF, and combustion of particulate matter collected on the CSF. The catalyzed sensor is disposed between an engine manifold and the CSF, and combusts CO and/or HC in the exhaust gas and inputs the control unit with a datum correlating with an enthalpy of combustion of HC and/or CO in the exhaust gas, thereby controlling the content of the combustible HC and/or CO in the exhaust gas flowing into the CSF. The catalysed sensor is the only catalysed component in the exhaust system disposed between the engine and the CSF.

13 Claims, 1 Drawing Sheet

U.S. PATENT DOCUMENTS

| | | | | |
|---|---|---|---|---|
| 6,952,918 | B2 * | 10/2005 | Imai et al. | 60/295 |
| 7,065,959 | B2 * | 6/2006 | Ueno et al. | 60/295 |
| 7,143,578 | B2 * | 12/2006 | Kakwani et al. | 60/286 |
| 7,533,524 | B2 * | 5/2009 | Wang et al. | 60/297 |
| 2003/0061802 | A1 * | 4/2003 | Nakatani et al. | 60/284 |
| 2003/0089104 | A1 * | 5/2003 | Colignon | 60/295 |
| 2003/0167756 | A1 | 9/2003 | Szymkowicz | |
| 2003/0188526 | A1 | 10/2003 | Hepburn et al. | |
| 2003/0192306 | A1 * | 10/2003 | Nakatani et al. | 60/288 |
| 2003/0221421 | A1 * | 12/2003 | Gui et al. | 60/295 |
| 2004/0139739 | A1 * | 7/2004 | Kagenishi | 60/289 |
| 2004/0226281 | A1 | 11/2004 | Coillard | |
| 2004/0261401 | A1 * | 12/2004 | Ohkl et al. | 60/285 |
| 2005/0044845 | A1 * | 3/2005 | Onodera et al. | 60/286 |
| 2005/0060990 | A1 * | 3/2005 | Ueno et al. | 60/295 |
| 2005/0097885 | A1 * | 5/2005 | Wang et al. | 60/297 |
| 2006/0005534 | A1 * | 1/2006 | Wirth et al. | 60/291 |
| 2006/0070374 | A1 * | 4/2006 | Gaiser et al. | 60/289 |
| 2006/0168947 | A1 * | 8/2006 | Durnholz et al. | 60/289 |
| 2006/0201144 | A1 * | 9/2006 | Gabe et al. | 60/299 |
| 2006/0248874 | A1 * | 11/2006 | Goersmann et al. | 60/274 |
| 2007/0044455 | A1 * | 3/2007 | Barasa et al. | 60/295 |

FOREIGN PATENT DOCUMENTS

| | | | | |
|---|---|---|---|---|
| DE | 26 43 739 | A1 | | 3/1978 |
| DE | 40 22 546 | A1 | | 1/1992 |
| EP | 1 580 411 | A1 | | 9/2005 |
| GB | 2 406 803 | A | | 4/2005 |
| GB | 2406803 | A | * | 4/2005 |
| GB | 2 452 354 | A | | 3/2009 |
| JP | 10-252450 | A | | 9/1998 |
| WO | WO-99/06681 | A1 | | 2/1999 |
| WO | WO-2004/079167 | A1 | | 9/2004 |

* cited by examiner

EXHAUST SYSTEM COMPRISING CATALYSED SOOT FILTER

CROSS-REFERENCE TO RELATED APPLICATIONS

This application is the U.S. National Phase application of PCT International Application No. PCT/GB2007/050059, filed Feb. 13, 2007, and claims priority of British Patent Application No. 0603898.8, filed Feb. 28, 2006, both of which are incorporated herein by reference.

FIELD OF THE INVENTION

The present invention relates to an exhaust system for a lean burn internal combustion engine comprising a catalysed soot filter (CSF), a control unit, and means, controllable by the control unit, for increasing a content of combustible hydrocarbon (HC) and/or carbon monoxide (CO) in an exhaust gas flowing into the CSF thereby to combust the HC and/or CO in the CSF, to increase the temperature of the CSF and to combust particulate matter (PM) collected thereon.

BACKGROUND OF THE INVENTION

It is known to use a CSF to meet legislated exhaust gas emissions for PM, CO and HC in light-duty diesel vehicles (as defined by the relevant legislation). A known problem with using CSFs is that PM can build up on the CSF during periods when the exhaust gas temperature is relatively cool, e.g. 150-200° C., such as during extensive periods of idling and/or in slow driving conditions. In such circumstances, backpressure in the system can rise undesirably as PM collects on the CSF. Typically this problem is met by adopting means actively to regenerate the CSF, i.e. inputting energy into the CSF actively to combust the PM.

One such active regeneration method involves increasing the content of combustible HC (typically the fuel that powers the engine or a product derived therefrom) and/or CO in the exhaust gas flowing into the CSF, thereby to combust the HC and/or CO in the CSF, to increase the temperature of the CSF and to combust PM collected thereon. Such an active regeneration event can be triggered when a suitable indicator of a condition of the CSF is detected, such as the back-pressure in the system increasing above a pre-determined threshold, a pre-determined time elapsing since the last regeneration or the vehicle travelling a pre-determined distance since the last regeneration. Such processes are typically controlled by a suitably programmed engine control unit (ECU) receiving suitable sensor inputs.

Generally, two means of increasing the content of a combustible HC and/or CO in the exhaust gas are used: injection of the HC directly into exhaust gas flowing in the exhaust system; and controlling the injection of HC into one or more engine cylinder. The latter means is more common in Original Equipment Manufacturer (OEM) applications and use of common rail injector systems can increase the flexibility in amount and timing of the injection. For example, two common rail injections can be performed during the expansion stroke to increase the combustion temperature and to enrich exhaust gases in HC:

(i) late post-injection occurring immediately before the exhaust valves open (bottom dead centre); and, additionally, (ii) early post-injection (called the after-injection) being added just after top dead centre.

In an exhaust system in current production, a diesel oxidation catalyst (DOC) is located downstream of any turbo of the engine and a CSF is disposed downstream of the DOC. During normal operation, PM is combusted passively in oxygen or $NO_2$ (the latter is generated from oxidising NO in the exhaust gas on the DOC or CSF). When it is desired actively to regenerate the CSF, the HC and/or CO content in the exhaust gas is increased and the HC and/or CO is combusted on the DOC upstream of the CSF and the CSF is exposed to the resulting increased exhaust gas temperature so that PM is combusted thereon. The inlet temperature of the CSF is controlled by controlling the amount of HC and/or CO injected into the exhaust gas. In practice, this control is done by measuring the temperature of exhaust gas flowing into the CSF (or post DOC) using a thermocouple and increasing HC injection if the temperature is too low or decreasing HC injection if the temperature is too high. This arrangement is an example of so-called closed loop control using the ECU.

A DOC is purposefully designed to promote the oxidation of CO and/or HC remaining in the exhaust gas following in-cylinder combustion in order to meet legislated emission standards.

As defined herein, a "thermocouple" comprises two wires of different metals joined at their ends to form a loop, wherein a temperature difference between the two junctions unbalances the contact potentials causing a current to flow round the loop. If the temperature of one junction is kept constant, that of the other is indicated by measuring the current.

Legislation and vehicle manufacturers are demanding increasing durability from exhaust system components, including catalysts for treating exhaust gases. Accordingly, it is necessary carefully to control the input of energy to a CSF to avoid thermally damaging the catalyst and/or the filter substrate. Therefore the level of control of active regeneration that is required is to increase the temperature of the CSF to a pre-determined level sufficient to promote combustion of PM, but not to exceed a pre-determined maximum inlet temperature thereby to ensure that the temperature increase within the CSF from PM oxidation is within pre-determined design tolerances.

It would be preferable if the exhaust system did not require the presence of both a DOC and a CSF in order to treat PM, CO and HC and, instead for the CSF unit to be coated with a catalyst capable of performing the functions of both the DOC and CSF thus providing a single catalyst unit. In practice, it is certainly possible to raise the temperature of the CSF sufficiently to combust PM by combusting combustible HC and/or CO on the CSF itself. However, there remains the problem of accurately controlling the energy input to the CSF in order to avoid exposing the catalyst coating and filter substrate to damagingly high temperatures, e.g. >650° C., but ensuring that sufficient energy is introduced to the CSF to combust PM thereon. A thermocouple may be placed within the CSF itself to measure the temperature, however there are a number of drawbacks with such an arrangement. Firstly, additional heat from combustion of PM cannot be differentiated from heat derived from combusting HC and/or CO from the exhaust gas thus rendering direct measurement of the inlet gas conditions difficult or practically impossible. Secondly, there are durability problems associated with placing a small diameter thermocouple within the cell structure of the CSF: the thermocouple or filter can be damaged.

We have now developed a way of controlling the active regeneration of a CSF without the need for a DOC to combust HC and/or CO upstream of the CSF.

U.S. Pat. No. 4,029,472 discloses a sensor for detecting residual combustibles in exhaust gas, especially internal combustion engine exhaust gas. The sensor comprises a pair of thermocouple junctions, wherein one junction is catalysed, the temperature differential between the junctions being proportional to residual combustibles in the exhaust gas. The document suggests that the sensor can be disposed upstream from a flow-through catalytic converter to detect actual residual amounts of unburned HC and/or CO in the exhaust gas stream. Alternatively, when the sensor is mounted downstream of the catalytic converter, it can be used to monitor the efficiency thereof.

EP 1580411 discloses an exhaust system for a diesel engine comprising an oxidation catalyst followed by a particulate filter. The oxidation catalyst comprises both platinum and palladium in a ratio $0.05 \leqq (Pd/Pd+Pt) \leqq 0.75$. For increasing filter temperature fuel is supplied into the oxidation catalyst.

SUMMARY OF THE INVENTION

According to one aspect, the invention provides an exhaust system for a lean burn internal combustion engine comprising: (a) a catalysed soot filter (CSF); (b) a control unit; (c) means, controllable by the control unit, for increasing a content of combustible HC and/or CO in an exhaust gas flowing into the CSF thereby to combust the HC and/or CO in the CSF, to increase the temperature of the CSF and to combust PM collected thereon; and (d) catalysed sensor means disposed between an engine manifold and the CSF for combusting CO and/or HC in exhaust gas flowing in the exhaust system and inputting the control unit with a datum correlating with an enthalpy of combustion of HC and/or CO in the exhaust gas, whereby the control unit, when in use, controls the combustible HC and/or CO introducing means in response to the datum input thereby to control the rate of contacting the CSF with combustible HC and/or CO.

BRIEF DESCRIPTION OF THE DRAWINGS

In order that the invention may be more fully understood, embodiments of the invention will now be described with reference to the accompanying drawings, in which.

DETAILED DESCRIPTION OF THE INVENTION

Figure 1:
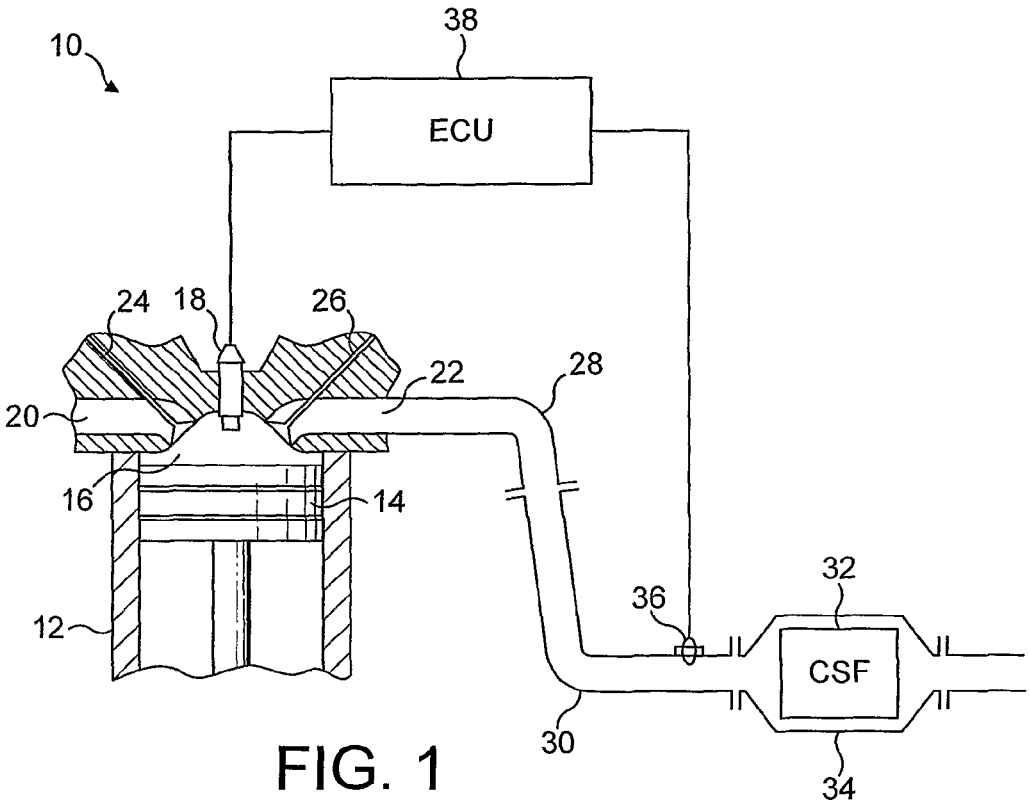
FIG. 1 shows a schematic representation of an apparatus comprising a light duty diesel engine and an exhaust system comprising a first embodiment according to the invention.

The sensor means can enable a processor in the control unit to estimate an exothermic temperature rise in the CSF resulting from the combustion of HC and/or CO present in the exhaust gas flowing into the CSF.

In one embodiment, the catalysed sensor means comprises a catalysed thermocouple junction. In a particular embodiment, the thermocouple catalyst comprises the catalyst used in the CSF, e.g. platinum supported on alumina. A suitably calibrated catalysed thermocouple can provide a direct correlation of a temperature of the downstream CSF because the thermocouple catalyst combusts HC and/or CO in the exhaust gas creating an exotherm that heats the thermocouple junction. A signal thus generated can be used to control, by closed loop feedback, the introduction of HC and/or CO thereby to maintain a temperature of the CSF within a pre-determined range.

In a further embodiment, the catalysed sensor means comprises the catalysed thermocouple junction of the first embodiment and additionally an uncatalysed reference thermocouple junction. Such a sensor is described in U.S. Pat. No. 4,029,472, the entire contents of which is incorporated herein by reference. This arrangement of two thermocouple junctions provides the advantage that the sensor is able to determine the heat derived from combustion of HC and/or CO on the CSF as well as the pre-CSF exhaust gas temperature so that additional feedback control can be provided to the control unit.

The catalyst in the CSF typically comprises at least one platinum group metal (PGM), but in particular embodiments it comprises Pt either alone or in combination with one or more additional PGM, such as both Pt and Pd or both Pt and Rh or all three of Pt, Pd and Rh including suitable promoters such as Mg, Ba or rare earth metals such as Ce. The material from which filter substrate monolith is made can support the catalyst or it can be supported on a surface area increasing washcoat component, e.g. particulate alumina.

In a particular embodiment, the catalysed sensor means is the only catalysed component in the exhaust system disposed between the engine and the CSF.

In one embodiment, the control unit is adapted to prevent the temperature of the CSF from exceeding 650° C. during active regeneration of the CSF (excluding heat derived from soot oxidation), thereby to reduce or prevent the likelihood of damaging the catalyst in the CSF.

In order to achieve desirable temperatures in the CSF to promote regeneration, in one embodiment, the control unit is adapted to maintain the CSF at 550° C. and above during active regeneration of the CSF.

In one embodiment, the exhaust system comprises an oxidation catalyst for generating an exotherm by combusting a portion only of the combustible HC and/or CO in the exhaust gas located between the engine manifold and the catalysed sensor means. The oxidation catalyst can comprise a substrate monolith having a volume of from 1/10 to 1/3 times the displacement of the engine to which the exhaust system is designed to be fitted.

The oxidation catalyst in this embodiment is entirely different to a DOC in that it is not intended to meet legislated emission standards for CO and HC. Instead, its duty is to combust a portion only of additional HC and/or CO introduced into the exhaust gas for the purpose of increasing the temperature at the CSF.

The oxidation catalyst is designed so that the combination of the oxidation catalyst activity and volume of the substrate monolith is insufficient to meet the relevant emission standards for HC and CO. In practice, oxidation catalyst can comprise one or more platinum group metal. In one embodiment, the sole PGM is platinum. In another embodiment, both platinum and palladium are used. The total PGM loading in the catalyst can be up to 240 $gft^{-3}$.

In an embodiment of the exhaust system comprising the exotherm-generating oxidation catalyst, the exhaust system comprises means for bypassing the catalyst during pre-determined operating conditions. Such bypassing means can include a conduit controlled by a valve arrangement controllable by the control unit. This embodiment provides increased design options to give the skilled engineer greater control over energy input to the CSF.

According to a further aspect, the invention provides an internal combustion engine and an exhaust system according to the invention. The engine can be a diesel engine, for example a light-duty diesel engine (according to the relevant legislation). Where the engine is naturally aspirated or supercharged, the catalysed sensor means can be disposed between the engine manifold and the CSF. Alternatively, where the engine is turbocharged, the catalysed sensor means can be disposed between the turbocharger outlet and the CSF.

In one embodiment, the means for increasing the content of the combustible HC and/or CO in the exhaust gas comprises a fuel injector in a cylinder of the engine. Alternatively, or in addition, the means to increase the content of combustible HC in the exhaust system may comprise an injector for injecting the combustible HC into an exhaust gas downstream of a location of the engine. If the exhaust system comprises an oxidation catalyst, as described hereinabove, the injector is located upstream of the oxidation catalyst.

According to another aspect, the invention provides a method of controlling active regeneration of a catalysed soot filter (CSF) in an exhaust system of an internal combustion engine, which method comprising the steps of:

(i) increasing a content of combustible hydrocarbon (HC) and/or carbon monoxide (CO) in an exhaust gas flowing into the CSF thereby to combust the HC and/or CO in the CSF, to increase the temperature of the CSF and to combust particulate matter collected thereon;

(ii) combusting HC and/or CO in the exhaust gas upstream of the CSF on a catalysed sensor means to generate a signal indicative of a concentration of HC and/or CO in the exhaust gas;

(iii) correlating the signal with a value for the enthalpy of combustion of HC and/or CO in the exhaust gas; and (iv) controlling the content of HC and/or CO in step (i) in response to the enthalpy value determined in step (iii), thereby to maintain a temperature of the CSF within and pre-determined range.

Referring to FIG. 1, an apparatus according to one embodiment of the invention is represented by the numeral 10, wherein 12 is an light-duty diesel engine body, 14 is a piston, 16 is a combustion chamber, 18 is a common rail fuel injector, 20 is an intake port, 22 is an exhaust port, 24 is an intake valve, 26 is an exhaust valve, 28 is an exhaust manifold, 30 is an exhaust pipe, 32 is a CSF, 34 is a can comprising exhaust gas diffusers for containing the CSF and holding it in communication with the exhaust pipe, 36 is a sensor comprising both a catalysed thermocouple junction and an uncatalysed reference thermocouple junction and 38 is an engine control unit (ECU) programmed, when in use, to control the common rail fuel injector during active regeneration of the CSF in response to detected input from sensor 36.

In use, the ECU 38 determines the mileage since the last active regeneration. When the mileage exceeds a pre-determined amount, e.g. 1000 km, the ECU controls the injector 18 to begin a series of injections to increase the temperature and optionally increase the HC and/or CO content of the exhaust gas entering the CSF. The ECU 38 is calibrated to determine the relative amount of combustible HC and/or CO entering the CSF as a function of the localised temperature increase caused by combusting HC and/or CO on the sensor. By a series of look-up tables or maps the ECU 38 determines the likely temperature rise in the CSF 32 caused by combusting the detected amount of HC and/or CO and controls the injection of combustible HC and/or CO via injector 18 accordingly.

If the ECU 38 determines that the rate of combustible HC and/or CO entering CSF 32 will cause the temperature of the CSF 32 to exceed a pre-determined maximum temperature, e.g. above about 650° C., ECU 38 reduces the rate and/or quantity of injection; or if the calculated temperature is below a pre-determined minimum threshold desirable to promote active regeneration of the CSF 32, e.g. below about 550° C., ECU 38 increases the rate and/or quantity of injection. Of course, if the calculated temperature is within a pre-determined temperature window, no change to the rate and/or quantity of injection is required, provided all factors affecting the CSF temperature, e.g. accelerator position, space velocity etc. remain substantially the same. The skilled engineer is able suitably to program ECU 38 to achieve the desired closed-loop control and no further details will be given herein.

Figure 2:
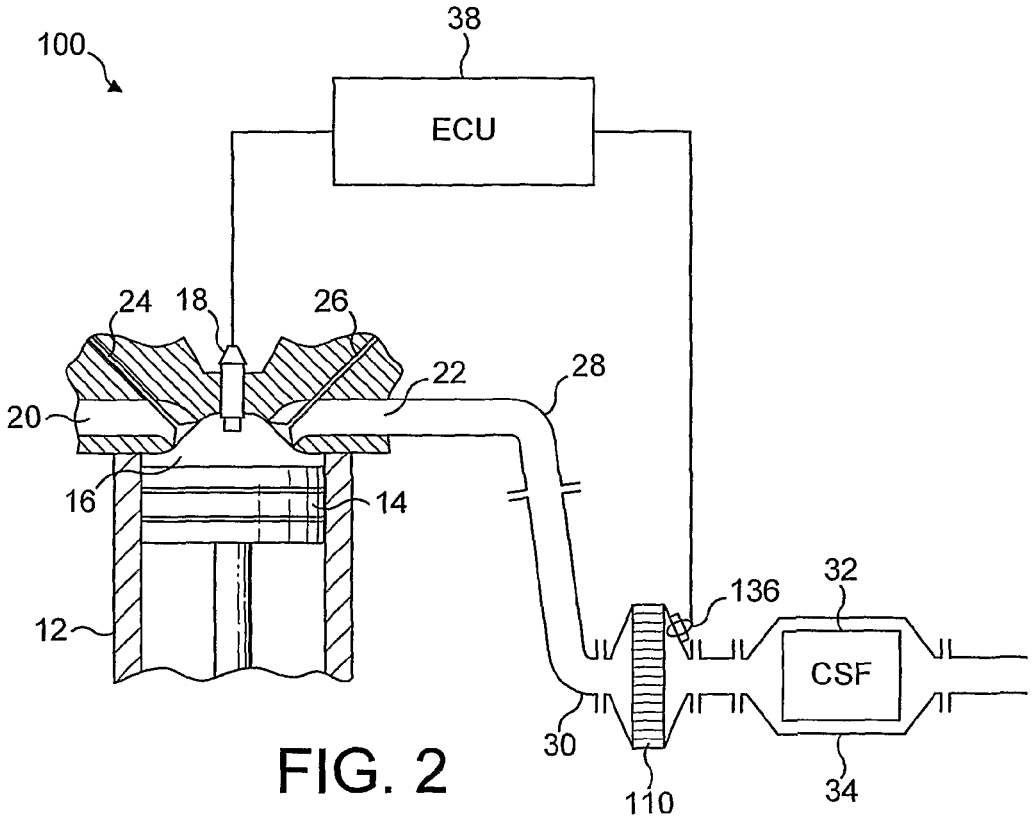
FIG. 2 shows a second embodiment according to the invention.

Referring to FIG. 2, reference numeral 100 refers to a second embodiment according to the invention, wherein like components from FIG. 1 carry the same reference numeral. In FIG. 2, 110 is a short e.g. 2 inch (5 cm) long 5.6 inch (14.2 cm) diameter substrate monolith (or "slice") e.g. of 400 cpsi ((cells per square inch) 62 cells $cm^{-2}$) coated with an oxidation catalyst of e.g. Pt/Alumina. Sensor 136 comprises a catalysed thermocouple junction located immediately behind "slice" 110, which sensor communicating with ECU 38.

In use, some HC and/or CO are combusted on the oxidation catalyst 110 and the exotherm generated in the exhaust gas is detected using sensor 136 in addition to the sensor detecting exotherm generated by combusting HC and/or CO on the catalysed sensor itself. A correlation can be made between the detected temperature increase in the exhaust gas and an expected temperature increase in the CSF.

The invention claimed is:

1. An exhaust system for a lean burn internal combustion engine comprising:

(a) a catalysed soot filter (CSF), comprising a catalyst;

(b) a control unit;

(c) means, controllable by the control unit, for increasing a content of combustible hydrocarbon (HC) and/or carbon monoxide (CO) in an exhaust gas flowing into the CSF thereby to combust the HC and/or CO in the CSF, to increase the temperature of the CSF and to combust particulate matter collected thereon; and (d) catalysed sensor means disposed between an engine manifold and the CSF for combusting CO and/or HC in exhaust gas flowing in the exhaust system and inputting the control unit with a datum correlating with an enthalpy of combustion of HC and/or CO in the exhaust gas, wherein the catalysed sensor means is the only catalysed component in the exhaust system disposed between the engine manifold and the CSF, whereby the control unit, when in use, controls the combustible HC and/or CO introducing means in response to the datum input thereby to control the content of the combustible HC and/or CO in the exhaust gas flowing into the CSF.

2. An exhaust system according to claim 1, wherein the catalysed sensor means comprises a catalysed thermocouple junction.

3. An exhaust system according to claim 2, wherein the catalysed sensor means comprises the catalysed thermocouple junction and an uncatalysed reference thermocouple junction.

4. An exhaust system according to claim 1, wherein the catalyst in the CSF comprises at least one platinum group metal.

5. An exhaust system according to claim 3, wherein the catalysed thermocouple junction comprises the same catalyst as the CSF.

6. An exhaust system according to claim 1, wherein the control unit is adapted to prevent the temperature of the CSF from exceeding a pre-determined temperature during active regeneration of the CSF.

7. An exhaust system according to claim 1, wherein the control unit is adapted to maintain the CSF at above a predetermined temperature during active regeneration of the CSF.

8. An exhaust system according claim 1, wherein the means for increasing the content of the combustible HC and/or CO comprises means for injecting combustible HC into the exhaust gas upstream of the CSF.

9. An apparatus comprising an internal combustion engine and an exhaust system according to claim 1.

10. An apparatus according to claim 9, wherein the means for increasing the content of combustible HC and/or CO in the exhaust gas comprises a fuel injector in a cylinder of the engine.

11. An exhaust system according to claim 1, wherein the catalyst in the CSF comprises platinum.

12. An exhaust system according to claim 1, wherein the catalyst in the CSF comprises platinum and palladium.

13. A method of controlling active regeneration of a catalysed soot filter (CSF), comprising a catalyst, in an exhaust system of an internal combustion engine, which method comprising the steps of: (i) increasing a content of combustible hydrocarbon (HC) and/or carbon monoxide (CO) in an exhaust gas flowing into the CSF thereby to combust the HC and/or CO in the CSF, to increase the temperature of the CSF and to combust particulate matter collected thereon; (ii) combusting HC and/or CO in the exhaust gas downstream from an engine manifold and upstream of the CSF on a catalysed sensor means to generate a signal indicative of a concentration of HC and/or CO in the exhaust gas, wherein the catalysed sensor means is the only catalysed component in the exhaust system disposed between the engine manifold and the CSF; (iii) correlating the signal with a value for the enthalpy of combustion of HC and/or CO in the exhaust gas; and (iv) controlling the content of HC and/or CO in step (i) in response to the enthalpy value determined in step (iii), thereby to maintain a temperature of the CSF within and pre-determined range.

* * * * *